US008581680B2

(12) United States Patent
Portier

(10) Patent No.: US 8,581,680 B2
(45) Date of Patent: Nov. 12, 2013

(54) CONNECTING DEVICE ADAPTABLE TO DIFFERENT CONTACTORS

(75) Inventor: Alain Portier, Lyons (FR)

(73) Assignee: ABB France (FR)

( * ) Notice: Subject to any disclaimer, the term of this patent is extended or adjusted under 35 U.S.C. 154(b) by 66 days.

(21) Appl. No.: 13/346,159

(22) Filed: Jan. 9, 2012

(65) Prior Publication Data

US 2012/0178304 A1 Jul. 12, 2012

(30) Foreign Application Priority Data

Jan. 10, 2011 (FR) ..... 11 50154

(51) Int. Cl.
*H01H 67/02* (2006.01)

(52) U.S. Cl.
USPC ..... 335/132; 355/202

(58) Field of Classification Search
USPC ..... 335/202, 132, 126, 131, 136, 282
See application file for complete search history.

(56) References Cited

U.S. PATENT DOCUMENTS 6,870,450 B2 * 3/2005 Bauer et al. ..... 335/132
7,541,900 B2 * 6/2009 Portier ..... 335/159
7,697,477 B2 * 4/2010 Courtney ..... 370/331
2012/0001706 A1 * 1/2012 Heckenkamp et al. ..... 335/11
2012/0242433 A1 * 9/2012 Eriksson et al. ..... 335/202

FOREIGN PATENT DOCUMENTS

DE 10013314 A1 10/2001
EP 1918958 A1 5/2008
EP 2107580 A1 10/2009
FR 2908233 A1 5/2008

* cited by examiner

*Primary Examiner* — Gary F. Paumen
(74) *Attorney, Agent, or Firm* — Cantor Colburn LLP

(57) ABSTRACT

A device for connecting a terminal of an operating coil of an electromagnetic contactor, the device having a first connecting piece electrically connected to a terminal of the operating coil, a second connecting piece arranged in the contactor opposite a surface of the contactor so as to be accessible from the outside of the insulating body of the contactor in order to enable the electrical connection between the contactor and an outside module, and at least one connecting member including a first connecting portion arranged to ensure the electric contact with the first connecting piece according to at least two different relative positions between the first connecting portion and the first connecting piece, and a second connecting portion arranged to ensure the electric contact with the second connecting piece according to at least two different relative positions between the second connecting portion and the second connecting piece.

15 Claims, 5 Drawing Sheets

CONNECTING DEVICE ADAPTABLE TO DIFFERENT CONTACTORS

TECHNICAL FIELD

The present invention relates to a connecting device of a terminal of an operating coil of an electromagnetic contactor.

BRIEF DESCRIPTION OF RELATED ART

It is known, in particular from document FR2908233, to position a contactor including an insulating body and an electronic card on which elastic electric connectors are positioned, for example of the CMS type, intended to receive a connecting strip enabling connection with an outside circuit in order to power an operating coil of the contactor.

This strip is intended to pass through the insulating body of the contactor through a passage formed therein. This passage must nevertheless not coincide with the location of a connection terminal of the contactor.

It is economically interesting for contactors of different calibers with a variable number of poles and belonging to a same line having a same spacing between the connecting pieces on their front surface to be able to receive different shared connecting modules or accessories.

Furthermore, this same line is generally equipped with a same magnetic circuit, a same coil and a same electronic card. However, the strips are specific to each contactor model of the line.

This great disparity in connecting strips causes significant cost overruns in the manufacture and assembly of the different contactors and causes an assembly difficulty due to their complex shape.

BRIEF SUMMARY

The present invention aims to resolve all or some of the aforementioned drawbacks.

To that end, the invention relates to a device for connecting a terminal of an operating coil of an electromagnetic contactor, said contactor comprising an insulating body and an operating coil housed in the insulating body, the connecting device comprising a first connecting piece electrically connected to a terminal of the operating coil, a second connecting piece arranged in the contactor opposite a surface of the contactor so as to be accessible from the outside of the insulating body of the contactor in order to enable the electrical connection between the contactor and an outside module, and at least one connecting member comprising a first connecting portion arranged to ensure the electric contact with the first connecting piece according to at least two different relative positions between the first connecting portion and the first connecting piece, and a second connecting portion arranged to ensure the electric contact with the second connecting piece according to at least two different relative positions between the second connecting portion and the second connecting piece, the conducting member being arranged according to at least one first position or a second spatial position between the first and second connecting pieces according to the relative positions of the first connecting portion relative to the first connecting piece and the second connecting portion relative to the second connecting piece.

This arrangement makes it possible to produce several different spatial combinations of the connecting device, thereby allowing it to be installed in several different contactor models as well as to connect a same outside module model on different contactors with minimal different pieces.

According to one aspect of the invention, the at least one conducting member includes a connecting body extending between the first connecting portion and the second connecting portion.

According to one aspect of the invention, at least one portion from amongst the first connecting piece and the second connecting piece comprises two housings for electrically and mechanically cooperating with a first or second portion for connecting to the at least one conducting member.

According to one aspect of the invention, a connecting portion of the at least one conducting member from amongst the first and second connecting portions comprises two elastic branches.

According to one aspect of the invention, the two housings of one of the first or second connecting pieces are dimensioned to contain the two elastic branches of the second connecting portion of the conducting member of the connecting device.

This arrangement makes it possible to produce different spatial combinations depending on whether a first or second connecting portion of the at least one conducting member is arranged in one of the two housings.

According to one aspect of the invention, the at least one conducting member is substantially in the shape of an "L" comprising a base forming a first connecting portion amongst the first and second connecting portions of the conducting member and a transverse branch at the base whereof the end forms a second connecting portion from amongst the first and second connecting portions of the conducting member.

According to one aspect of the invention, the connecting device comprises an insulating tube intended to be connected, for example by clipping, to the insulating body of the contactor and at least partially electrically insulating the second connecting piece of the connecting device.

According to one aspect of the invention, the insulating tube forms a housing for the second connecting piece.

According to one aspect of the invention, the second connecting piece is substantially in the shape of a "T," the head of which is arranged to cooperate electrically with the second connecting portion of the at least one conducting member and the base constitutes a connecting portion accessible from the outside of the insulating body of the contactor.

According to one aspect of the invention, the relative positioning between the first connecting piece and a connecting portion of the second connecting piece, accessible from outside the insulating body of the contactor, is identical for at least two different positions of the at least one conducting member.

According to one aspect of the invention, the first connecting piece comprises an elastic electrical connector, for example of the CMS type.

This arrangement makes it easier to insert the first connecting portion of the conducting member of the connecting device in the first connecting piece while ensuring good electrical contact.

According to one aspect of the invention, the elastic electrical connector is arranged on an electronic card.

The present invention also relates to an electromagnetic contactor comprising a device for powering an operating coil including a first connecting device as previously described intended to connect a first operating coil terminal and a second connecting device as previously described intended to connect a second operating coil terminal.

According to one aspect of the invention, the electromagnetic contactor comprises a set of terminal cavities delimited in the insulating body by cavity walls, a passage being formed in a wall of a terminal cavity, in order to house the conducting member.

The present invention also relates to an assembly comprising a plurality of electromagnetic contactors as described before, in which a connecting device for an operating terminal of the given coil of a first type of contactor is arranged in a different spatial position from a connecting device for a same control terminal in a second type of contactor of said assembly so as to keep an identical relative position, irrespective of the type of contactor, between the first connecting piece and a connecting portion of the second connecting piece accessible from outside the insulating body of the contactor.

BRIEF DESCRIPTION OF THE FIGURES

In any event, the invention will be well understood using the following description, in reference to the appended diagrammatic drawing showing, as a non-limiting example, a connecting device according to the invention.

DETAILED DESCRIPTION

Figure 1:
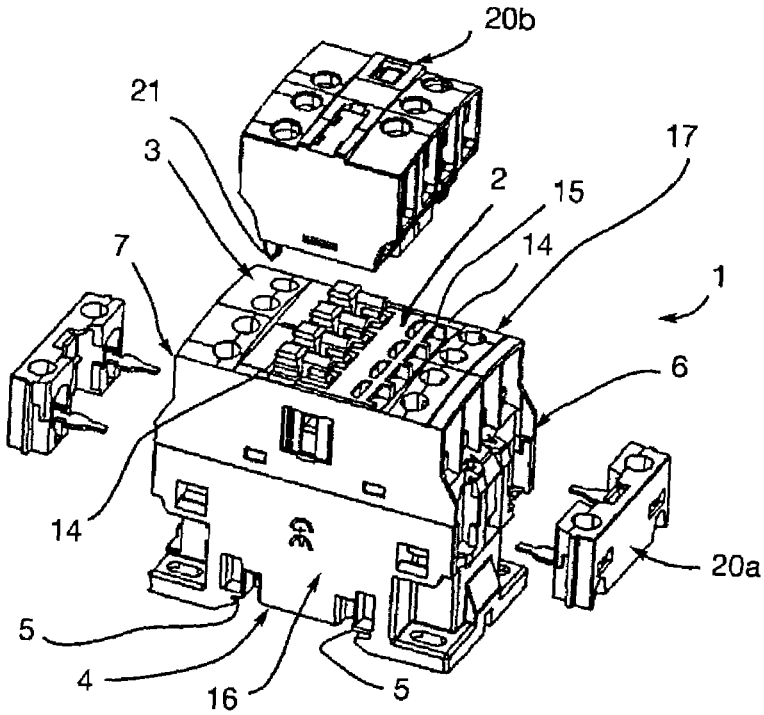
FIG. 1 is a perspective view of a contactor according to the state of the art with detached connecting modules.
Figure 2:
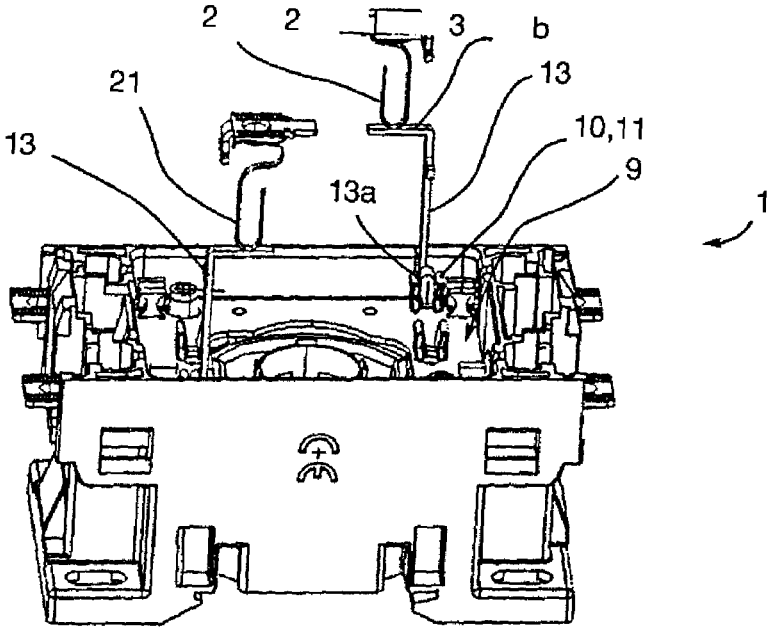
FIG. 2 is a perspective view of the contactor of FIG. 1 whereof part of the insulating body is removed.

As illustrated in FIGS. 1 to 2, a contactor 1 according to the state of the art has an insulating body 2 delimited by a front surface 3, a rear surface 4 comprising fixing means 5 on a support rail (not illustrated), opposite upstream 6 and downstream 7 side surfaces situated on either side of the support rail, as well as opposite side surfaces 16, 17 attaching the front surface 3 to the rear surface 4 as well as the upstream side surface 6 to the downstream side surface 7.

The contactor 1 includes an operating coil 8 which, depending on the connector 1 model, ensures contact or cuts contact between the connecting terminals 15 of the contactor 1 when it is powered.

Connecting modules 20*a*, 20*b* or other accessories are used respectively to power the operating coil 8 from the outside of the contactor 1 or to perform additional functions of the timing or interface block type.

Two types of connecting modules 20*a*, 20*b* of separate structures are used depending on whether it is intended to be fixed on the front surface 3 or on an upstream 6 or downstream 7 surface of the contactor 1.

The present invention is intended for the connection of a connecting module 20*b* or other accessories intended to be fixed on the front surface 3 of the contactor 1.

Such a connecting module 20*b* comprises connecting pieces 21, 22 assuming the form of elastic loops.

This connecting module 20*b* also comprises means for fixing on the front surface 3 made up of elastic snapping portions intended to cooperate with a fixing finger of the insulating body 2 formed on the front surface 3 and comprising lateral grooves.

The operating coil 8 is received in the insulating body 2, below an electronic card 9 including a printed circuit on which is arranged a pair 10 of connecting pieces 11, 12 electrically connected to the power terminals of the operating coil 8.

These connecting pieces 11, 12 are embodied by elastic connectors 11, 12 arranged opposite the front surface 3 and diagonally relative to the support rail.

The elastic connectors 11, 12 of the pair 10 are of the CMS type in the shape of a harp allowing assembly/disassembly of the contactor 1 by pre-mounted blocks.

The elastic connectors 11, 12 of the pair 10 each support a rigid pad 13*a* forming the lower end of a strip 13 intended to pass through the insulating body 2 of the contactor 1 by a passage 14 emerging on the front surface of the contactor 1 in order to allow its upper end 13*b* to form an electrical contact with one of the connecting pieces 21, 22 of the connecting module 20*b* intended to be fixed on the front surface 3 of the contactor 1.

In a contactor 1 according to the state of the art, the connecting strip 13, which constitutes a connecting device between a connecting piece 11, 12 electrically connected to a power terminal of an operating coil 8 of a contactor 1 and a connecting piece 21, 22 of a connecting module 20*b* intended to be connected to the contactor 1, is made in a single piece.

Figure 3:
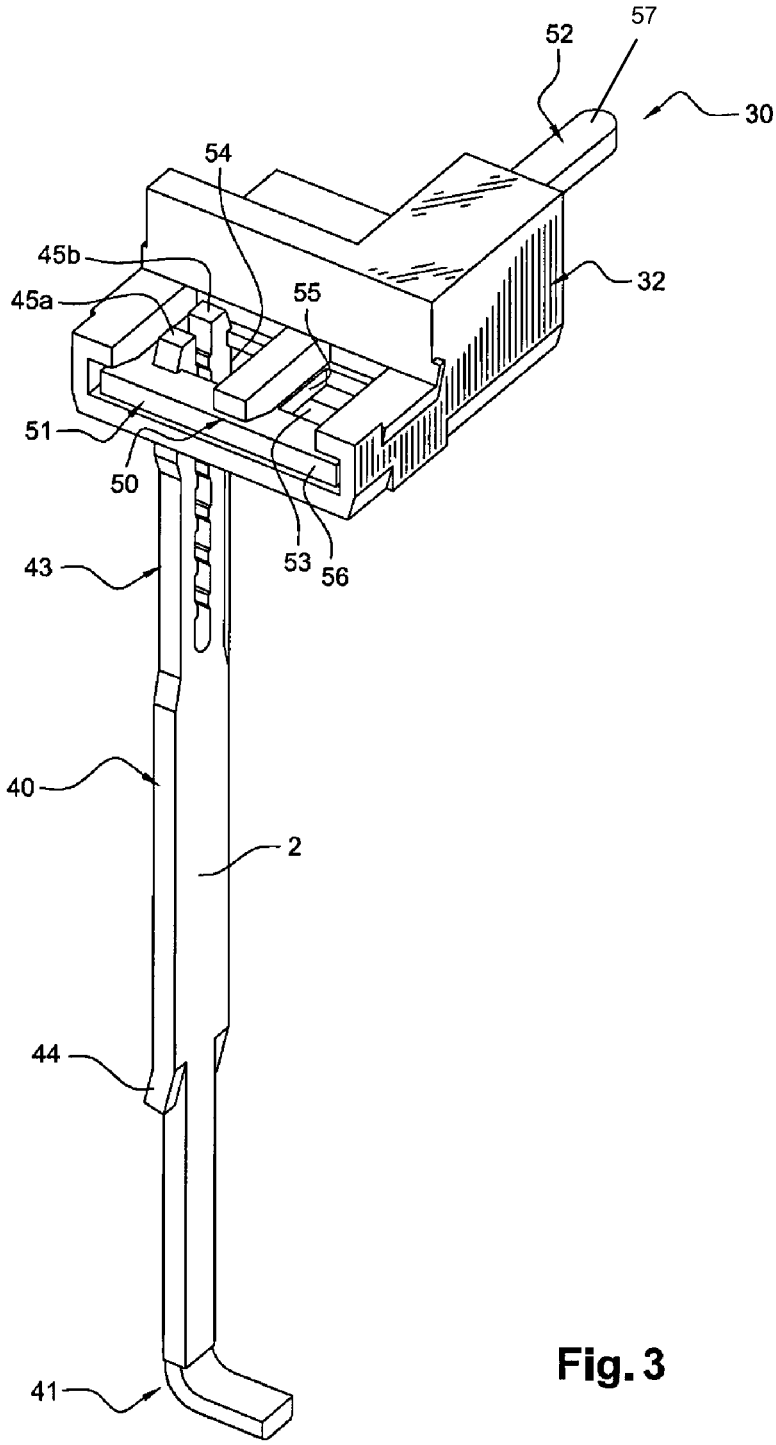
FIG. 3 is a perspective view of the connecting device according to the invention.
Figure 4:
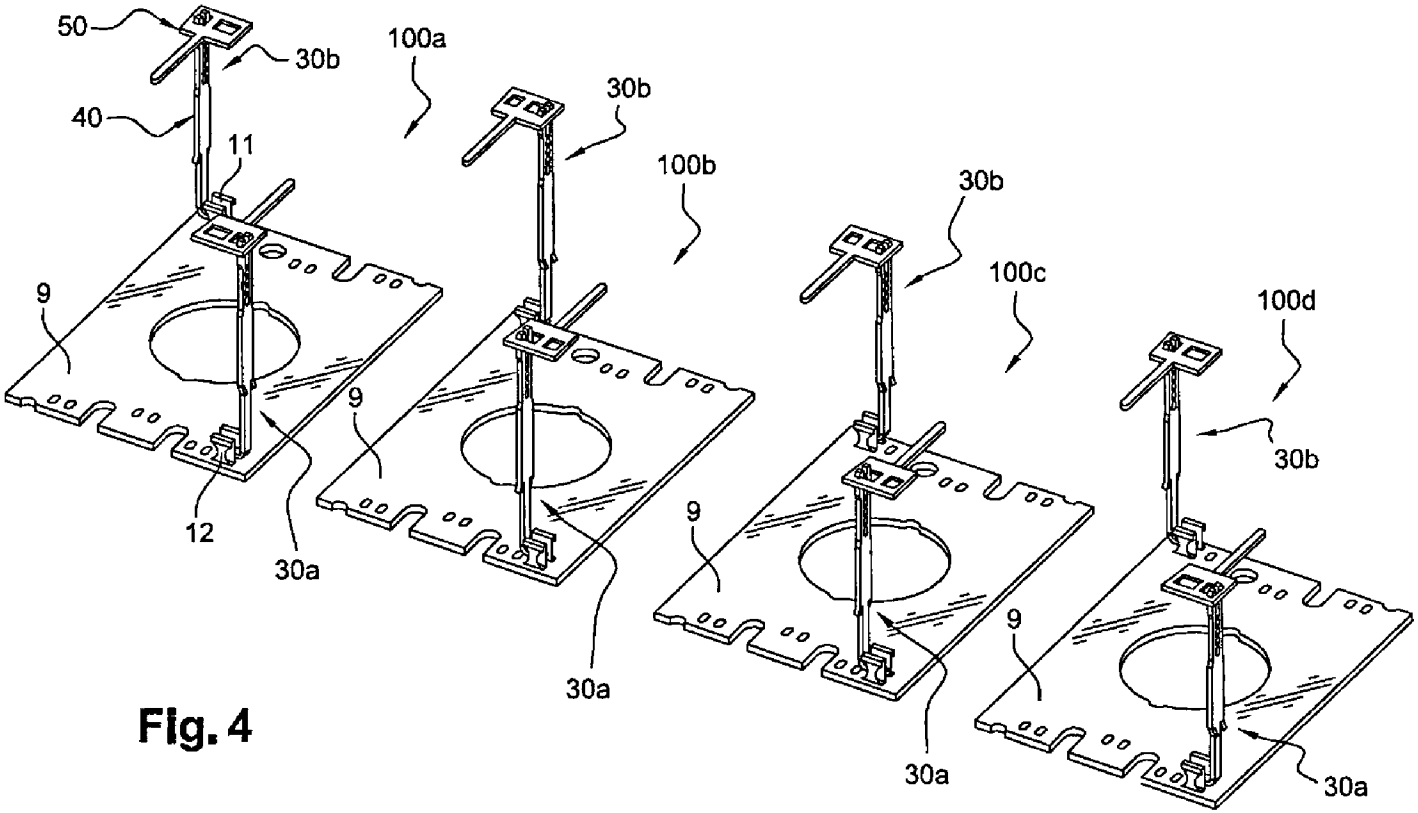
FIG. 4 shows several of the different spatial combinations allowed by the connecting device of FIG. 3 on a same electronic card.

The connecting device 30 according to the invention, shown in FIGS. 3 and 4, includes a first connecting piece 11, 12, a conducting member 40 and a second connecting piece 50.

Each of these pieces 11, 12, 50 as well as the member 40 is made from a rigid conductive material.

Figure 6:
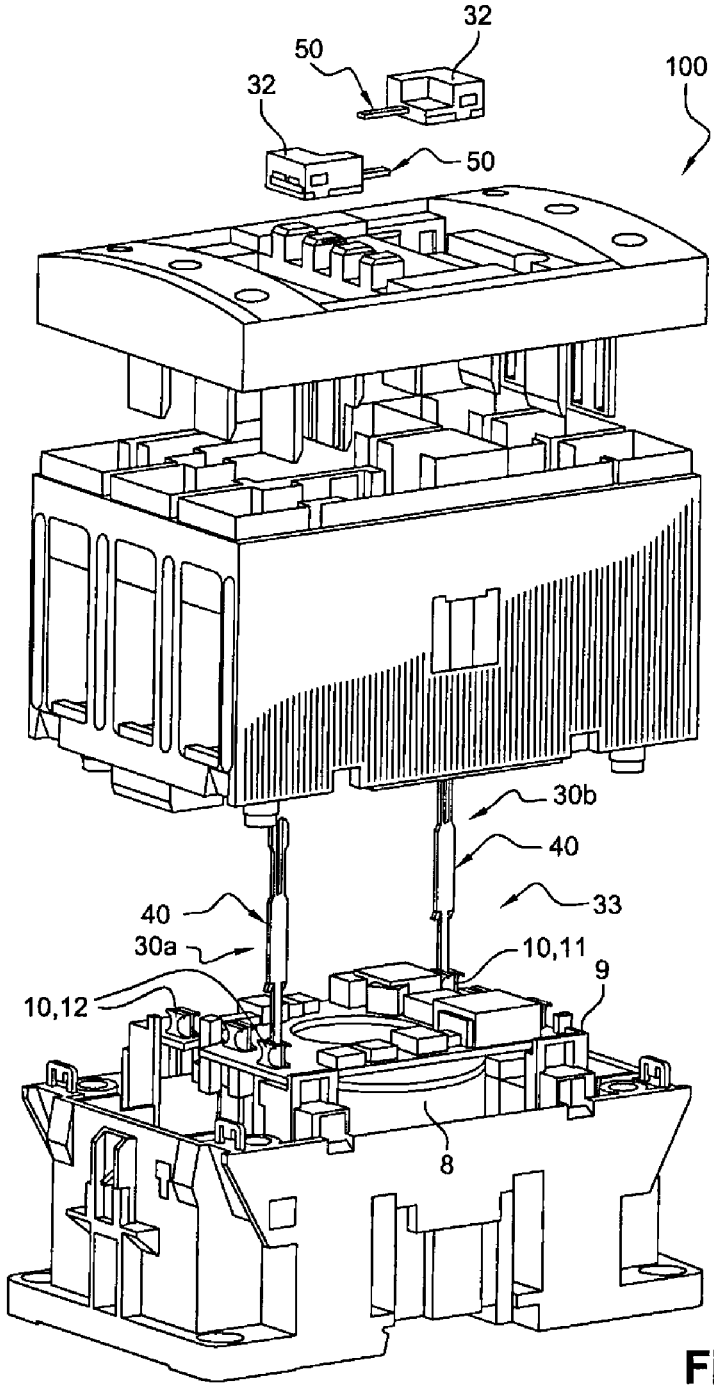
FIG. 6 is an exploded perspective view of a contactor according to the invention.

The conducting member 40 is substantially in the shape of an "L" whereof the base corresponds to a first connecting portion 41 intended to ensure the electrical contact with a first connecting piece 11, 12 connected to a terminal of an operating coil 8 belonging to a contactor 100 according to the invention illustrated for example in FIG. 6, and whereof the end of the branch of the "L" shape corresponds to a second connecting portion 43 arranged to ensure the electrical contact with the second connecting piece 50 of the connecting device 30.

The first connecting portion 41 and the second connecting portion 43 are electrically and mechanically connected by a rigid and conducting body 42.

Of course, the body can comprise several portions connected to each other provided that the electrical continuity is ensured between these different portions.

The body 42 comprises retaining means 44 arranged to block the conducting member 40 in a passage 31 formed in the insulating body 2 at a wall of a cavity of a terminal 15 of the contactor 100.

The "L" shape of this conducting member 40 allows positioning on the connecting piece 11, 12 by inserting its first connecting portion 41 according to two different spatial combinations: either by orienting the back of the branch of the "L" opposite a first side surface 16, or by orienting the back of the branch of the "L" across from a second side surface 17 opposite the first side surface 16 of the connector 100.

The second connecting portion 43 comprises two elastic branches 45*a*, 45*b* flexible relative to one another along a plane substantially transverse to the direction in which the first connecting portion 41 of the conducting member 40 corresponding to the base of the "L" shape extends.

The second connecting piece 50 is substantially in the shape of a "T" whereof the head corresponds to a first connecting portion 51 and the base corresponds to a second connecting portion 52.

The second connecting portion 52 corresponding to the base of the "T" shape is eccentric relative to its head corresponding to its first connecting portion 51.

The first connecting portion 51 extends along a rectangular surface 56 comprising a first rectangular through housing 53, and a second through opening 54 that is also rectangular formed transverse to the surface 56, the contours of the two rectangular housings 53, 54 being aligned on the contours of the rectangular shape of the surface 56.

The two housings 53, 54 are separated by a shared border 55 located in the extension of the second connecting portion 52 corresponding to the base of the "T" shape and extending transversely eccentrically from a side forming a length of the rectangular surface 56 of the first connecting portion 51.

The first housing 53 comprises a length smaller than the length of the second housing 54 for an identical width.

These two housings 53, 54 are arranged to cooperate electrically with the elastic branches 45*a*, 45*b* of the second connecting portion 43 of the conducting member 40 and bearing on the lengths of the rectangular shapes of either of the two housings 53, 54 thereby offering at least two different spatial combinations for connecting the second connecting portion 43 of the conducting member 40 on the first connecting portion 51 of the second connecting piece 50.

Lastly, the connecting device 30 according to the invention comprises a tube 32 intended to be connected, for example by clipping, to the insulating body 2, on the front surface 3 of the contactor 100 and partially electrically insulating the second connecting piece 50 from the connecting device 30.

This tube 32 nevertheless leaves visible the free end of the second connecting portion 52 of the second connecting piece 50 corresponding to a connecting portion 57 arranged across from the front surface 3 of the contactor 100 so as to allow contact with a connecting piece 21, 22 of the connecting module 20*b* intended to be fixed on the front surface 3 of the contactor 100.

Thus, the use of an electronic card 9 on which two connecting devices are arranged as described above with two first connecting pieces 11, 12 including a deviation specific to one or more contactor models 100*a*, 100*b*, 100*c*, 100*d* forms a power supply device 33 of an operating coil 8 of a contactor 100*a*, 100*b*, 100*c*, 100*d*.

Figure 5:
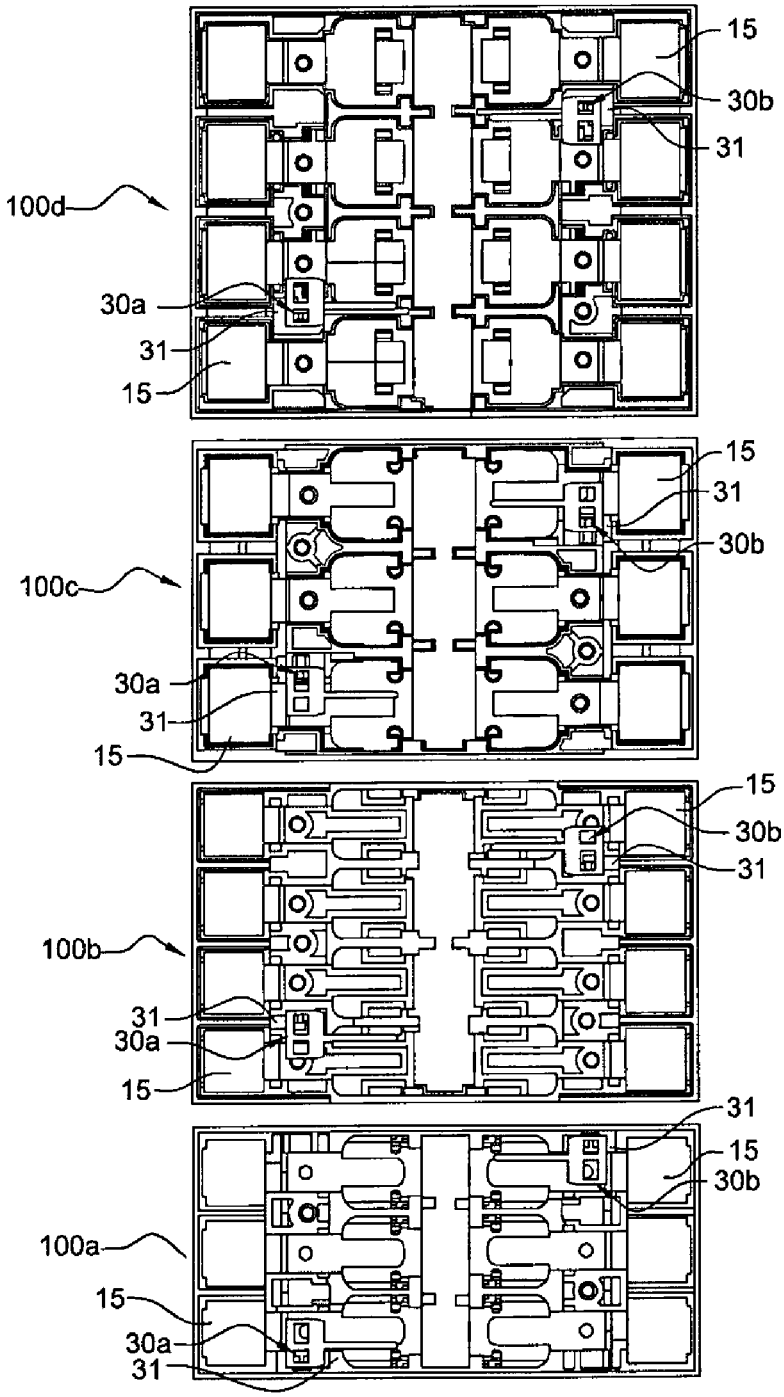
FIG. 5 shows the application of the different spatial combinations of FIG. 4 to different contactor models.

As illustrated in FIG. 5 for four different contactor models 100*a*, 100*b*, 100*c*, 100*d*, the various spatial combinations offered by the use of connecting device 30 on the electronic card 9 of each of said contactors 100*a*, 100*b*, 100*c*, 100*d* makes it possible to preserve a constant deviation between the two free ends of the second connecting portion 52 of the second connecting piece 50 of each of the two connecting devices 30*a*, 30*b* used in a same contactor 100*a*, 100*b*, 100*c*, 100*d*.

Furthermore, these various spatial combinations as well as the eccentricity of the second connecting portion 52 of the second connecting piece 50 relative to the first connecting portion 51 of the second connecting piece 50 allow the passage 31 for the connecting body 42 of each conducting member 40 of each connecting device 30*a*, 30*b* in the insulating body 2 of each of the contactor models 100*a*, 100*b*, 100*c*, 100*d* to be formed in a wall of a cavity of a terminal 15 of a contactor 100*a*, 100*b*, 100*c*, 100*d*, thereby preserving the functionality of each of the terminals 15 of a contactor 100*a*, 100*b*, 100*c*, 100*d*.

A same model of connecting module 20*b* can thus be connected to different contactor models 100*a*, 100*b*, 100*c*, 100*d* made from the same connecting pieces.

Although the invention has been described in reference to particular embodiments, it is of course in no way limited thereto and encompasses all technical equivalents of the described means as well as combinations thereof.

The invention claimed is:

1. A device for connecting a terminal of an operating coil of an electromagnetic contactor, said contactor comprising an insulating body and an operating coil housed in the insulating body, the connecting device comprising:

a first connecting piece electrically connected to a terminal of the operating coil, a second connecting piece arranged in the contactor opposite a surface of the contactor so as to be accessible from the outside of the insulating body of the contactor in order to enable the electrical connection between the contactor and an outside module; and at least one conducting member comprising:

a first connecting portion arranged to ensure the electric contact with the first connecting piece according to at least two different relative positions between the first connecting portion and the first connecting piece, and a second connecting portion arranged to ensure the electric contact with the second connecting piece according to at least two different relative positions between the second connecting portion and the second connecting piece, the conducting member being arranged according to at least one first position or a second spatial position between the first and second connecting pieces according to the relative positions of the first connecting portion relative to the first connecting piece and the second connecting portion relative to the second connecting piece.

2. The connecting device according to claim 1, wherein the at least one conducting member includes a connecting body extending between the first connecting portion and the second connecting portion.

3. The connecting device according to claim 1, wherein at least one piece from amongst the first connecting piece and the second connecting piece comprises two housings for electrically and mechanically cooperating with a first or second portion for connecting to the at least one conducting member.

4. The connecting device according to claim 3, wherein a connecting portion of the at least one conducting member from amongst the first and second connecting portions comprises two elastic branches.

5. The connecting device according to claim 4, wherein the two housings of one of the first or second connecting pieces are dimensioned to contain the two elastic branches of the second connecting portion of the conducting member of the connecting device.

6. The connecting device according to claim 1, wherein the at least one conducting member is substantially in the shape of an "L" comprising a base forming a first connecting portion amongst the first and second connecting portions of the conducting member and a transverse branch at the base whereof the end forms a second connecting portion from amongst the first and second connecting portions.

7. The connecting device according to claim 1, including an insulating tube intended to be connected, for example by clipping, to the insulating body of the contactor and at least partially electrically insulating the second connecting piece of the connecting device.

8. The connecting device according to claim 7, wherein the insulating tube forms a housing for the second connecting piece.

9. The connecting device according to claim 1, wherein the second connecting piece is substantially in the shape of a "T," the head of which is arranged to cooperate electrically with the second connecting portion of the at least one conducting member and the base constitutes a connecting portion accessible from the outside of the insulating body of the contactor.

10. The connecting device according to claim 1, wherein the relative positioning between the first connecting piece and a connecting portion of the second connecting piece, accessible from outside the insulating body of the contactor, is identical for at least two different positions of the at least one conducting member.

11. The connecting device according to claim 1, wherein the first connecting piece comprises an elastic electrical connector, for example of the CMS type.

12. The connecting device according to claim 11, wherein the elastic electrical connector is arranged on an electronic card.

13. An electromagnetic contactor comprising a device for powering an operating coil including a first connecting intended to connect a first operating coil terminal and a second connecting device intended to connect a second operating coil terminal, the first and second connecting devices being devices according to claim 1.

14. The electromagnetic contactor according to claim 13, comprising a set of terminal cavities delimited in the insulating body by cavity walls, a passage being formed in a wall of a terminal cavity, in order to house the conducting member.

15. An assembly comprising a plurality of electromagnetic contactors according to claim 13, in which a connecting device for an operating terminal of the given coil of a first type of contactor is arranged in a different spatial position from a connecting device for a same control terminal in a second type of contactor of said assembly so as to keep an identical relative position, irrespective of the type of contactor, between the first connecting piece and a connecting portion of the second connecting piece accessible from outside the insulating body of the contactor.

* * * * *